US011680765B1

(12) United States Patent
Painter

(10) Patent No.: US 11,680,765 B1
(45) Date of Patent: Jun. 20, 2023

(54) FIREARM BARREL WITH NON-METAL OUTER SLEEVE

(71) Applicant: Aaron E. Painter, Elkhorn, WI (US)

(72) Inventor: Aaron E. Painter, Elkhorn, WI (US)

( * ) Notice: Subject to any disclaimer, the term of this patent is extended or adjusted under 35 U.S.C. 154(b) by 13 days.

(21) Appl. No.: 17/087,676

(22) Filed: Nov. 3, 2020

Related U.S. Application Data

(63) Continuation-in-part of application No. 16/434,207, filed on Jun. 7, 2019, now Pat. No. 10,907,921, which is a continuation-in-part of application No. 15/394,155, filed on Dec. 29, 2016, now Pat. No. 10,365,061.

(51) Int. Cl.
*F41A 21/44* (2006.01)
*F41A 21/28* (2006.01)

(52) U.S. Cl.
CPC ..... *F41A 21/44* (2013.01); *F41A 21/28* (2013.01)

(58) Field of Classification Search
CPC .. F41A 3/12; F41A 21/00; F41A 21/02; F41A 21/20; F41A 21/28; F41A 21/44
USPC ..... 42/76.01; 89/14.05, 14.1, 16
See application file for complete search history.

(56) References Cited

U.S. PATENT DOCUMENTS 2,516,926 A * 8/1950 Simpson ..... F41A 5/24 42/76.01
2,655,837 A * 10/1953 Johnson ..... F41A 9/29 89/33.2
2,935,912 A * 5/1960 Hartley ..... F41A 13/12 89/14.1
2,965,994 A * 12/1960 Sullivan ..... F41C 23/16 42/71.01
3,742,640 A * 7/1973 Thomsen ..... F41A 21/02 42/76.01
4,211,146 A * 7/1980 Bradley ..... F41A 21/02 89/16
5,125,179 A * 6/1992 Campbell ..... B29C 70/56 42/76.02
5,600,912 A * 2/1997 Smith ..... F41A 21/02 42/76.01
5,692,334 A * 12/1997 Christensen ..... F41A 21/02 42/76.02
5,753,846 A * 5/1998 Koon ..... F41A 21/28 42/75.02

(Continued)

*Primary Examiner* — Joshua E Freeman
*Assistant Examiner* — Benjamin S Gomberg
(74) *Attorney, Agent, or Firm* — Ryan Kromholz & Manion, S.C.

(57) ABSTRACT

A firearm barrel with non-metal outer sleeve preferably includes an elongated tube, a first non-metal tube, a second non-metal tube, a sleeve nut and a coupler bushing. A first raised sleeve support section and a raised coupler section are formed on the elongated sleeve. The raised coupler section is formed in substantially a middle of the elongated tube. The bushing inner diameter is sized to slidably receive an outer diameter of the raised coupler section. The first and second non-metal tubes include a tube inner diameter and a plurality of openings formed through a wall thereof. The tube inner diameters are sized to slidably receive an outer diameter of the first raised sleeve support section and each end of the coupler bushing. The sleeve nut retains the first and second non-metal tubes and the coupler bushing on the elongated tube. A second embodiment includes a single non-metal tube.

13 Claims, 7 Drawing Sheets

(56) References Cited

U.S. PATENT DOCUMENTS

| | | | | |
|---|---|---|---|---|
| 7,353,741 | B2 * | 4/2008 | Brixius | F41A 13/06<br>42/90 |
| 8,312,663 | B2 * | 11/2012 | Johnson | F41A 23/16<br>42/76.01 |
| 8,595,971 | B2 * | 12/2013 | Johnson | F41C 27/22<br>42/97 |
| 8,794,122 | B2 * | 8/2014 | Adolphsen | F41A 5/26<br>89/193 |
| 9,796,057 | B2 * | 10/2017 | Tertin | F41A 21/04 |
| 2007/0193102 | A1 * | 8/2007 | Briggs | F41A 21/02<br>42/76.02 |
| 2011/0146130 | A1 * | 6/2011 | Emde | F41A 35/02<br>42/96 |
| 2016/0109204 | A1 * | 4/2016 | Leone | F41A 21/18<br>42/76.1 |

* cited by examiner 1
12
14
18
20
22
32
34
36
40
42
44
46
48
52
64
66
100
102
104
4

FIG. 6
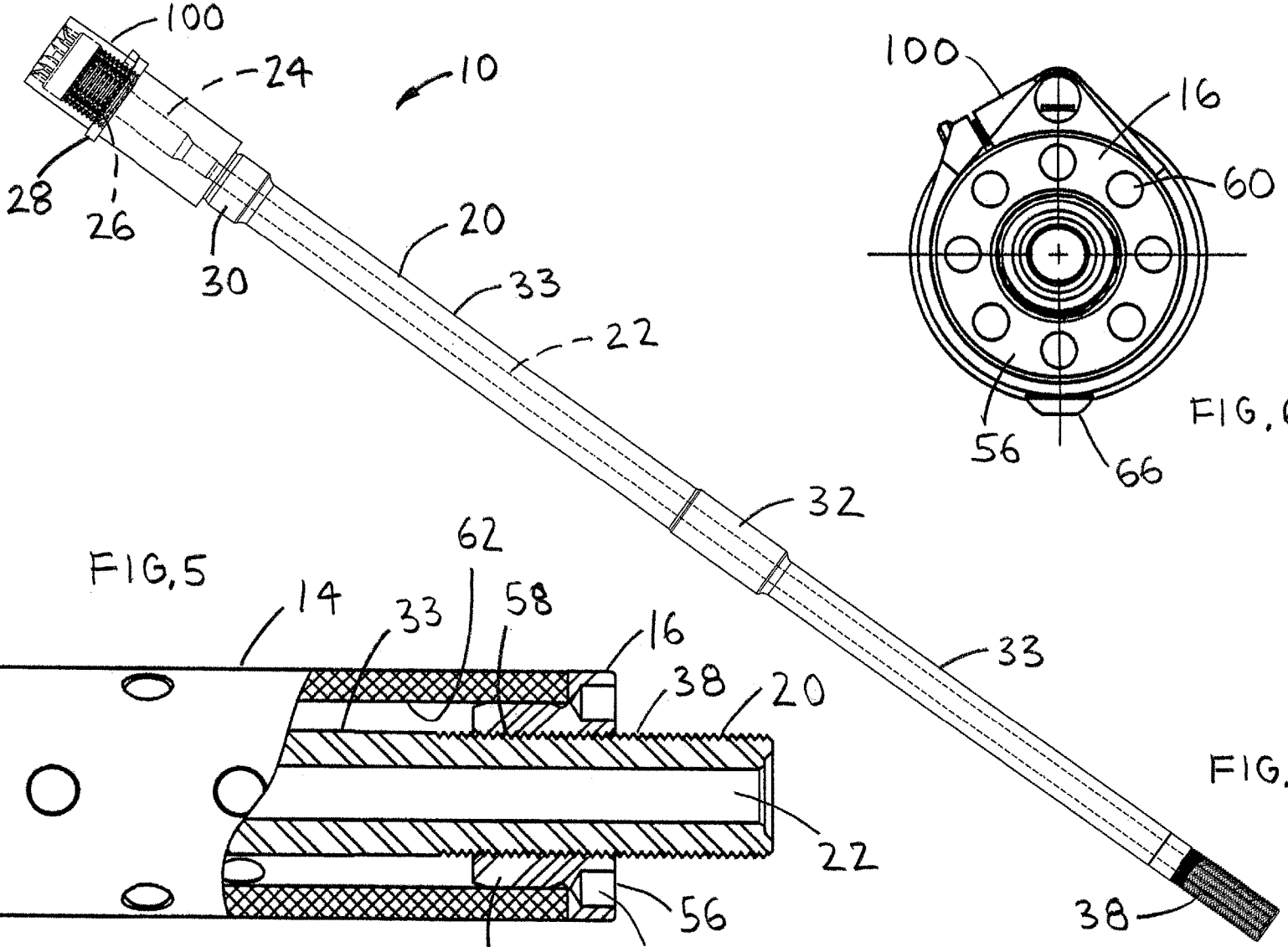
FIG. 7
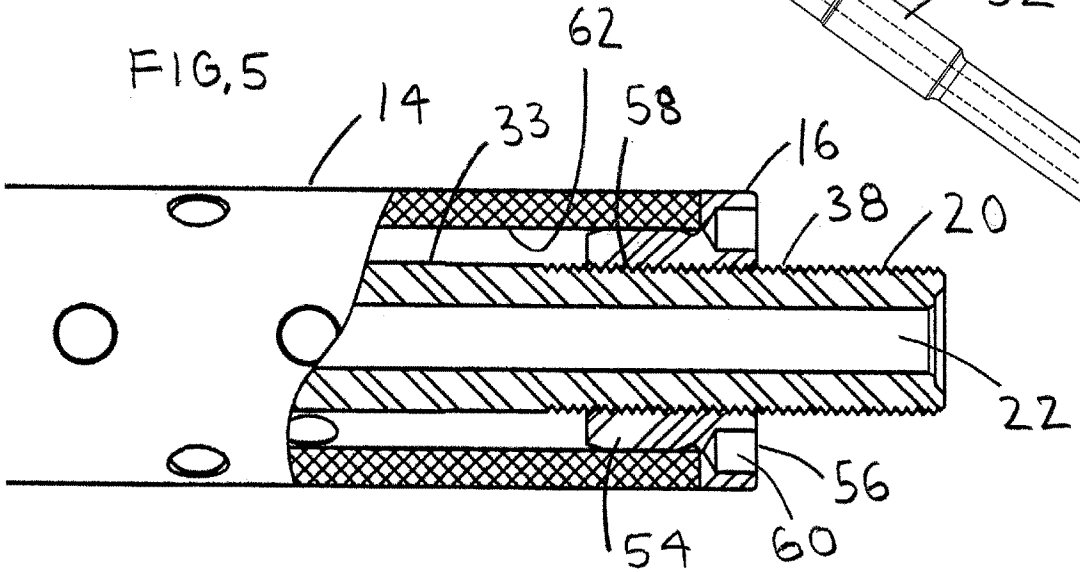
FIG. 5

FIREARM BARREL WITH NON-METAL OUTER SLEEVE

CROSS-REFERENCES TO RELATED APPLICATIONS

This continuation in part patent application takes priority from patent application Ser. No. 16/434,207, filed on Jun. 7, 2019, which takes priority from patent application Ser. No. 15/394,155, filed on Dec. 29, 2016, now Pat. No. 10,365,061, issued on Jul. 30, 2019.

FIELD OF THE INVENTION

The present invention relates generally to firearms and more specifically to a firearm barrel with non-metal outer sleeve, which may be handled after use.

DISCUSSION OF THE PRIOR ART

It appears that the prior art does not teach or suggest a firearm barrel with non-metal outer sleeve, which may be handled after use.

Accordingly, there is a clearly felt need in the art for a firearm barrel with non-metal outer sleeve, which may be handled after repeated firings.

SUMMARY OF THE INVENTION

The present invention provides a firearm barrel with non-metal outer sleeve, which may be handled after use. The firearm barrel with non-metal outer sleeve preferably includes a firearm barrel, a first non-metal tube, a second non-metal tube, a sleeve nut and a coupler bushing. The firearm barrel includes an elongated tube. A barrel inner diameter is formed through a length of the elongated tube. A lead-in bore is formed concentric with the barrel inner diameter at an entrance end of the elongated tube. A threaded tap is preferably formed in the entrance end of the elongated tube to threadably receive an extension barrel. Suitable twist rifling is then applied to the barrel inner diameter. Material is preferably removed from the elongated tube to form an end flange, a reduced outer diameter, a first raised sleeve support section and a raised coupler section. The end flange is formed on an entrance end of the elongated tube. The first sleeve support is formed near the end flange. The raised coupler section is formed in substantially a middle of the elongated tube. A gas escape hole is formed through the raised coupler section to the barrel inner diameter. A sleeve thread is formed on an exit end of the elongated tube. The firearm barrel is preferably fabricated from any suitable steel, but other materials may also be used.

The coupler bushing includes a bushing inner diameter, a first reduced diameter and a second reduced diameter. The first reduced diameter is formed on a first end of the coupler bushing and the second reduced diameter end formed on a second end thereof. A combination gas escape and fastener hole is formed through the coupler bushing. The bushing inner diameter is sized to slidably receive an outer diameter of the raised coupler section. The coupler bushing is preferably fabricated from any suitable metal, such as steel. The first non-metal tube includes a first tube inner diameter and a plurality of first openings are formed through a wall of the first non-metal tube. The plurality of first openings may have any suitable spacing, size and shape. The first tube inner diameter is sized to slidably receive an outer diameter of the first raised sleeve support section and the first reduced diameter. The first non-metal tube is preferably fabricated from carbon fiber, but other non-metal materials could also be used.

The sleeve nut preferably includes a tube end and a rotation flange. The rotation flange is formed on an end of the tube end. A threaded bore is formed through a length of the sleeve nut to threadably receive the sleeve thread of the elongated tube. A plurality of holes are preferably formed in the rotation flange to receive pins of a spanner wrench. However, wrench flats could be formed on an outer perimeter of the rotation flange. The second non-metal tube includes a second tube inner diameter and a plurality of second openings are formed through a wall of the second non-metal tube. The plurality of second openings may have any suitable spacing, size and shape. The second tube inner diameter is sized to slidably receive an outer diameter of the second reduced diameter and the tube end of the sleeve nut. The second non-metal tube is preferably fabricated from carbon fiber, but other non-metal materials could also be used.

The firearm barrel with non-metal outer sleeve is preferably assembled in the following manner. The first non-metal tube is slid over the exit end of the elongated tube on to the first raised sleeve support section. The coupler bushing is slid over the exit end of the elongated tube and on to the raised coupler section. The first reduced diameter of the coupler bushing is slid into the first tube inner diameter of the first non-metal tube. The combination gas escape and fastener hole of the bushing sleeve is aligned with the gas escape hole of the elongated barrel. A gas block is slid over the bushing sleeve. A threaded fastener is inserted through a hole in the gas block and the combination gas escape and fastener hole and threaded into a threaded tap in one end of the combination gas escape and fastener hole. The second non-metal tube is slid over the exit end of the elongated tube and on to the second reduced diameter of the coupler bushing. The sleeve nut is threaded onto the sleeve thread to retain the first and second non-metal tubes on the elongated tube.

A second embodiment of a firearm barrel with non-metal outer sleeve preferably includes a second firearm barrel, a non-metal tube and the sleeve nut. The second firearm barrel includes a second elongated tube. A second barrel inner diameter is formed through a length of the second elongated tube. Suitable twist rifling is applied to the second barrel inner diameter. Material is preferably removed from the second elongated tube to form an end taper, a reduced outer diameter and a raised sleeve support section. The end taper is formed near an entrance of the second elongated tube. The raised sleeve support section is formed adjacent the end taper. The raised sleeve preferably includes a straight knurled portion disposed in front of the raised sleeve support section. A sleeve thread is formed on an exit end of the second elongated tube. The firearm barrel is preferably fabricated from any suitable steel, but other materials may also be used.

The non-metal tube includes a tube inner diameter and a plurality of openings formed through a wall of the non-metal tube. The plurality of openings may have any suitable spacing, size and shape. The tube inner diameter is sized to slidably receive an outer diameter of the raised sleeve support section and the first reduced diameter. The non-metal tube is preferably fabricated from carbon fiber, but other non-metal materials could also be used.

The second embodiment of the firearm barrel with non-metal outer sleeve is preferably assembled in the following manner. The non-metal tube is slid over the exit end of the second elongated tube on to the raised sleeve support section. The sleeve nut is threaded onto the sleeve thread to retain the non-metal tube on the second elongated tube.

Accordingly, it is an object of the present invention to provide a firearm barrel with non-metal outer sleeve, which may be handled after repeated firings.

These and additional objects, advantages, features and benefits of the present invention will become apparent from the following specification.

BRIEF DESCRIPTION OF THE DRAWINGS

FIG. 5 is an enlarged cut-away view of a sleeve nut of a firearm barrel with non-metal outer sleeve in accordance with the present invention.

FIG. 6 is an enlarged end view of a firearm barrel with non-metal outer sleeve in accordance with the present invention.

FIG. 7 is a side view of an elongated tube of a firearm barrel with non-metal outer sleeve in accordance with the present invention.

FIG. 10 is a perspective view of a second embodiment of a firearm barrel with non-metal outer sleeve in accordance with the present invention.

DETAILED DESCRIPTION OF THE PREFERRED EMBODIMENTS

Figure 1:
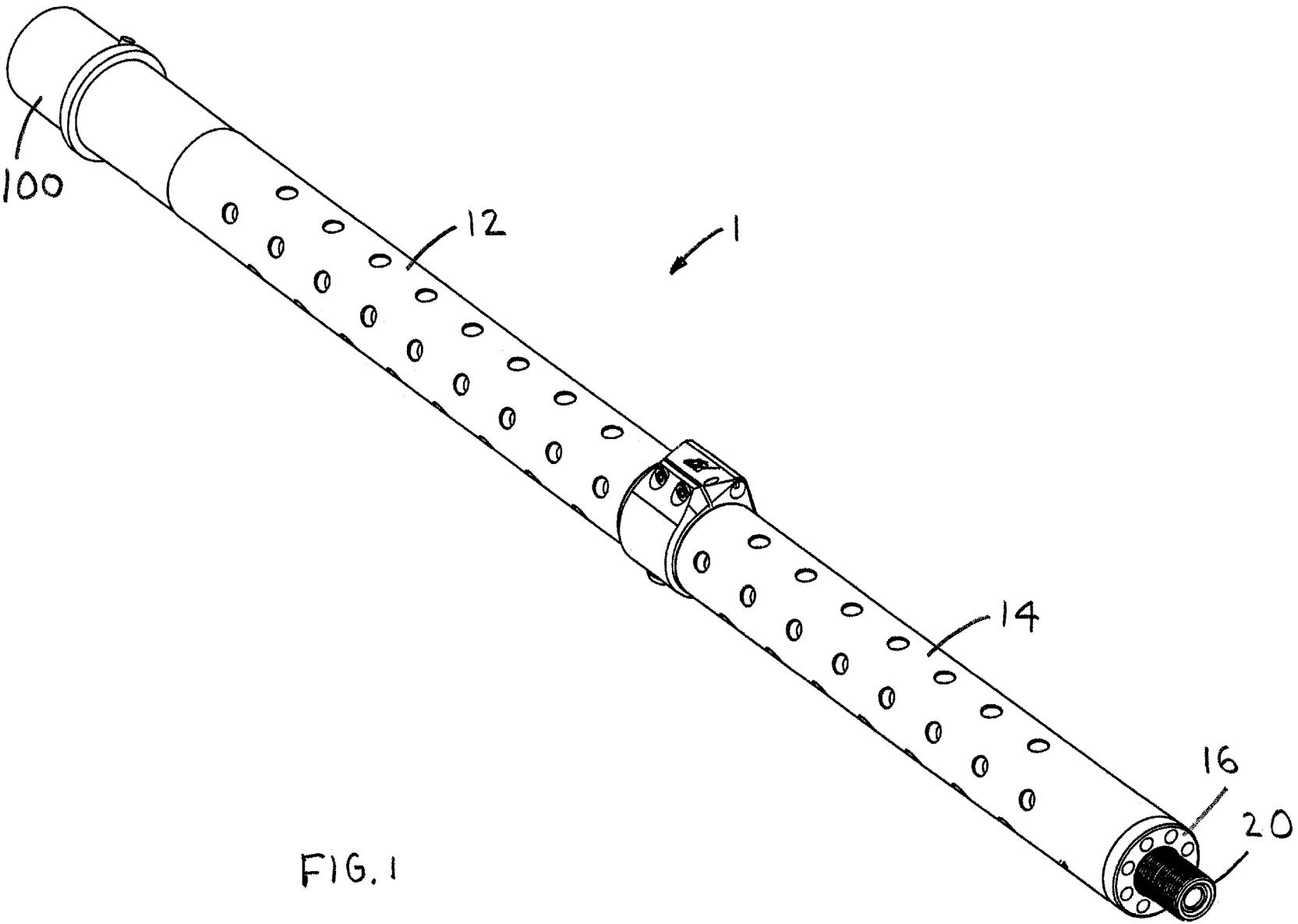
FIG. 1 is a perspective view of a firearm barrel with non-metal outer sleeve in accordance with the present invention.
Figures 2, 3, 4:
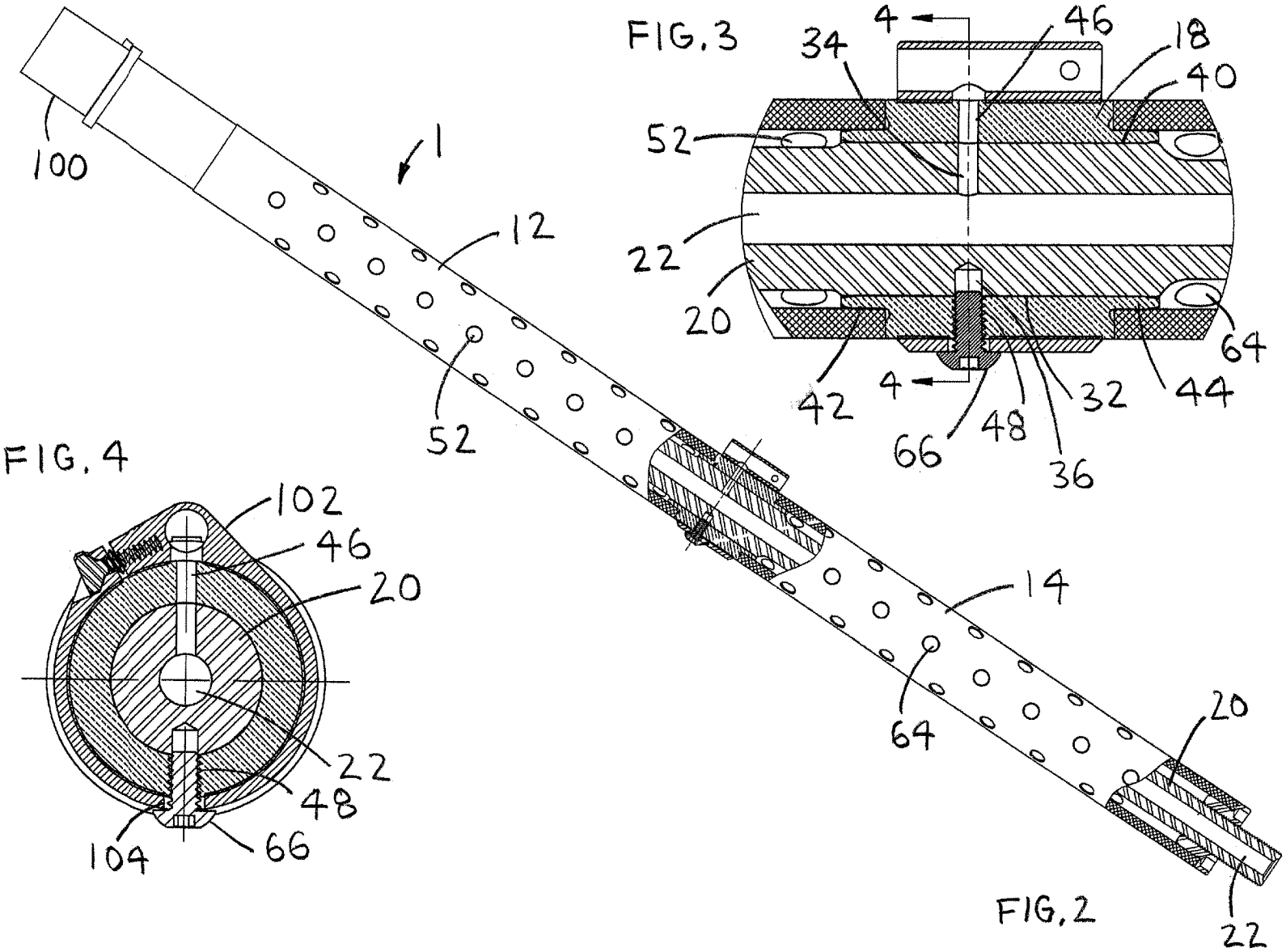
FIG. 2 is a side view of a firearm barrel with non-metal outer sleeve with cut-away sections of a gas block, coupler bushing and sleeve nut in accordance with the present invention.
FIG. 3 is an enlarged cut-away view of a gas block and coupler bushing of a firearm barrel with non-metal outer sleeve in accordance with the present invention.
FIG. 4 is an enlarged cross sectional view of a gas block and coupler bushing of a firearm barrel with non-metal outer sleeve cut through FIG. 3 in accordance with the present invention.

With reference now to the drawings, and particularly to FIG. 1, there is shown a perspective view of a firearm barrel with non-metal outer sleeve 1. With reference to FIGS. 2-7, the firearm barrel with non-metal outer sleeve 1 preferably includes a firearm barrel 10, a first non-metal tube 12, a second non-metal tube 14, a sleeve nut 16 and a coupler bushing 18. The firearm barrel 10 includes an elongated tube 20. A barrel inner diameter 22 is formed through a length of the elongated tube 20. A lead-in bore 24 is formed concentric with the barrel inner diameter 22 at an entrance end of the elongated tube 20. A threaded tap 26 is preferably formed in the entrance end of the elongated tube 20 to receive an extension barrel 100. Extension barrels are well known in the art and do not need to explained in detail. Suitable twist rifling is then applied to the barrel inner diameter 22. Material is preferably removed from the elongated tube 20 to form an end flange 28, a first raised sleeve support section 30, a raised coupler section 32 and a reduced outer diameter 33. The reduced diameter 33 has a diameter measurement, which is less than a diameter measurement of the first raised sleeve support section 30 and the raised coupler section 32. The end flange 28 is formed on the entrance end of the elongated tube 20. The first sleeve support 32 is formed near the end flange 28. The raised coupler section 32 is formed in substantially a middle of the elongated tube 20. A gas escape hole 34 is formed through the raised coupler section 32 to the barrel inner diameter 22. A barrel clearance hole 36 is formed in the raised coupler section 32, but not through to the barrel inner diameter 22. A sleeve thread 38 is formed on an exit end of the elongated tube 20. The firearm barrel 10 is preferably fabricated from any suitable steel, but other materials may also be used.

Figure 8:
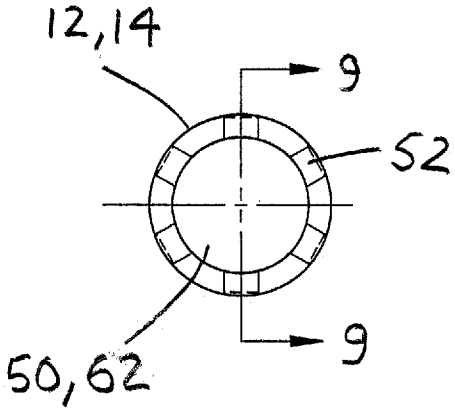
FIG. 8 is an end view of a first or second non-metal tube of a firearm barrel with non-metal outer sleeve in accordance with the present invention.
Figure 9:
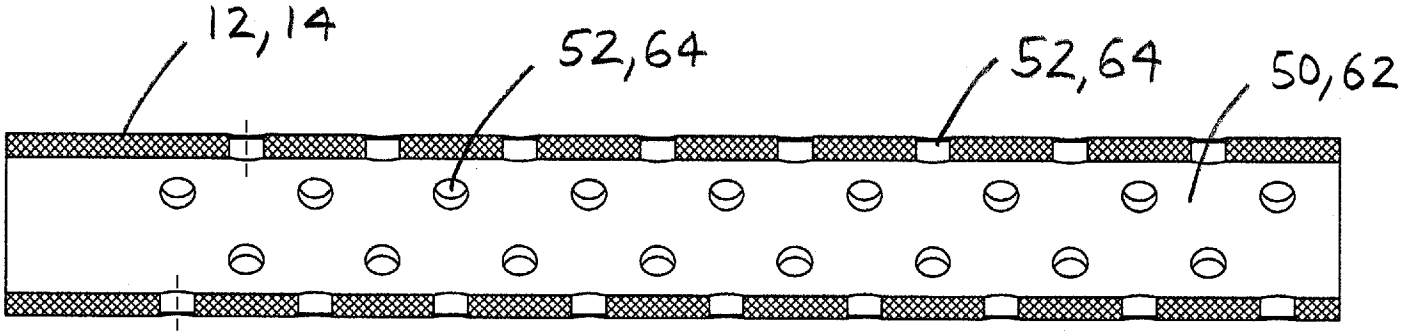
FIG. 9 is a cross-sectional view of a first or second non-metal tube of a firearm barrel with non-metal outer sleeve cut through FIG. 8 in accordance with the present invention.
Figure 1D:
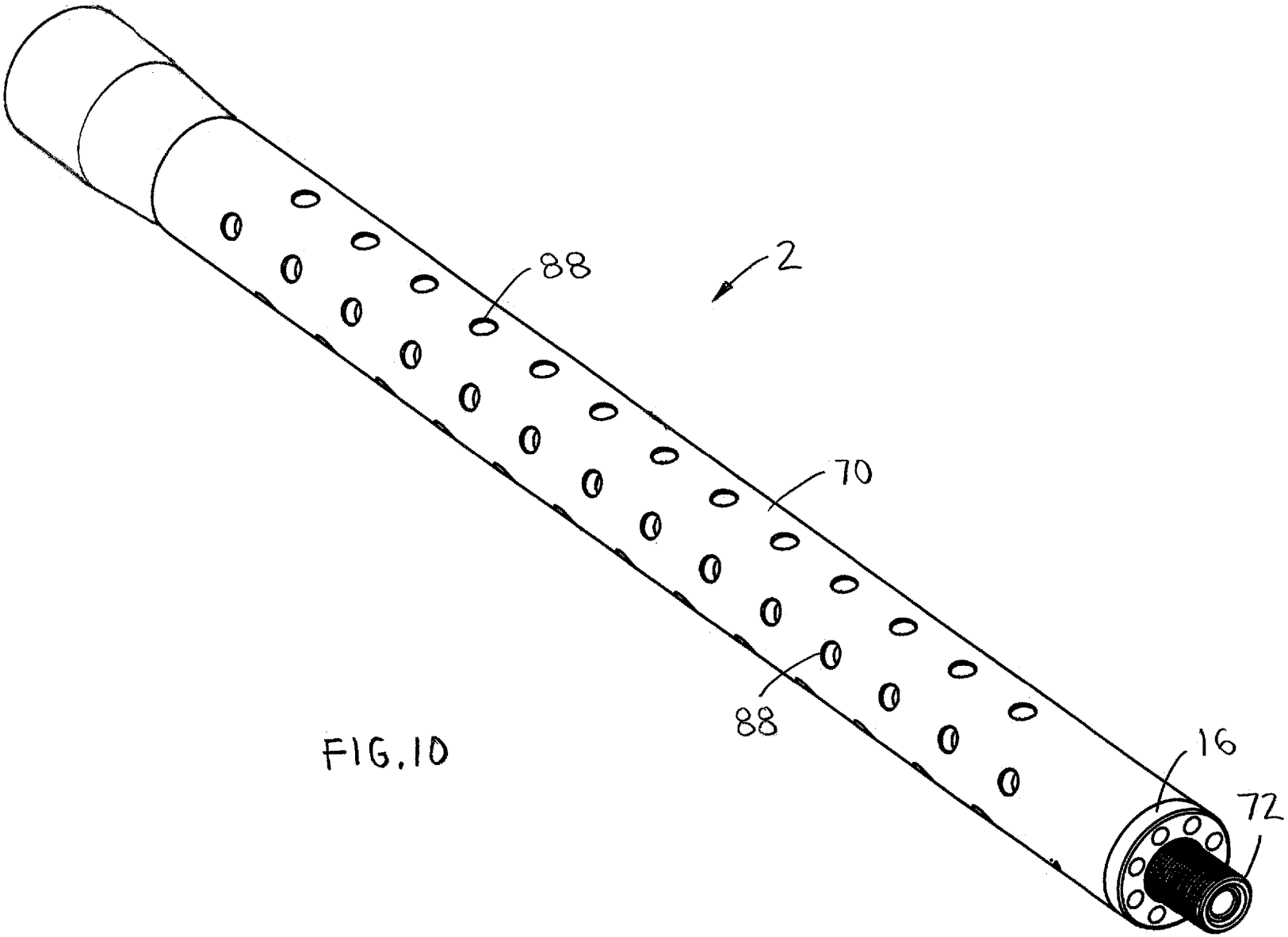

The coupler bushing 18 includes a bushing inner diameter 40, a first reduced diameter 42 and a second reduced diameter 44. The first reduced diameter 42 is formed on a first end of the coupler bushing 18 and the second reduced diameter end 44 formed on a second end thereof. A combination gas escape and fastener hole 46 is formed through coupler bushing 18. A threaded tap 48 is formed in one end of the combination gas escape and fastener hole 46. The bushing inner diameter 40 is sized to slidably receive an outer diameter of the raised coupler section 32. The coupler bushing 18 is preferably fabricated from any suitable metal, such as steel. With reference to FIGS. 8-9, the first non-metal tube 12 includes a first tube inner diameter 50 and a plurality of first openings 52 are formed through a wall of the first non-metal tube 12. The plurality of first openings 52 may have any suitable spacing, size and shape. The first tube inner diameter 50 is sized to slidably receive an outer diameter of the first raised sleeve support section 30 and the first reduced diameter 42. However, the first reduced diameter 42 may be threadably engaged with the inner diameter 50 of the first non-metal tube 12. The first non-metal tube 12 is preferably fabricated from carbon fiber, but other non-metal materials could also be used.

The sleeve nut 16 preferably includes a tube end 54 and a rotation flange 56. The rotation flange 56 is formed on an end of the tube end 54. A threaded bore 58 is formed through a length of the sleeve nut to threadably receive the sleeve thread 38 of the elongated tube 20. A plurality of pin holes 60 are formed in the rotation flange 56 to receive pins of a spanner wrench. The second non-metal tube 14 includes a second tube inner diameter 62 and a plurality of second openings 64 are formed through a wall of the second non-metal tube 14. The plurality of second openings 64 may have any suitable spacing, size and shape. The second tube inner diameter 62 is sized to slidably receive an outer diameter of the second reduced diameter 44 and the tube end 54 of the sleeve nut 16. However, the second reduced diameter 44 may be threadably engaged with the inner diameter 62 of the second non-metal tube 14. The second non-metal tube 14 is preferably fabricated from carbon fiber, but other non-metal materials could also be used.

The firearm barrel with non-metal outer sleeve 1 is preferably assembled in the following manner. The first non-metal tube 12 is slid over the exit end of the elongated tube 20 on to the first raised sleeve support section 30. The coupler bushing 18 is slid over the exit end of the elongated tube 20 and on to the raised coupler section 32. The first reduced diameter 42 of the coupler bushing 18 is slid into a first tube inner diameter 50 of the first non-metal tube 12. The reduced diameter 33 has a diameter measurement, which is less than a diameter measurement of the first reduced diameter 42, the second reduced diameter 44 and the tube end 54 to create an air gap between the reduced diameter 33 and the first and second tube inner diameters 50, 64. The combination gas escape and fastener hole 46 of the bushing sleeve 18 is aligned with the gas escape hole 34 of the elongated barrel 20. A gas block 102 is slid over the bushing sleeve 18. A threaded fastener 66 is inserted through a hole 104 in the gas block 102 and threaded into the threaded tap 48 in the coupler bushing 18. The second non-metal tube 14 is slid over the exit end of the elongated tube 20 and on to the second reduced diameter 44 of the coupler bushing 18. The sleeve nut 16 is threaded onto the sleeve thread 38 to retain the first and second non-metal tubes 12, 14 on the elongated tube 20. Heat from the elongated barrel 20 escapes through the plurality of first and second openings 52, 64. Tightening the sleeve nut 16 has the unexpected result of tensioning the rifling in the inner diameter of the elongated tube and improving shooting accuracy of the firearm barrel with non-metal outer sleeve 1. Tightening the sleeve nut 16 also stretches the elongated tube 20. The first non-metal tube 12 and the second non-metal tube 14 allow the weight of the firearm barrel with non-metal outer sleeve 1 to be reduced while improving shooting accuracy.

Figure 11:
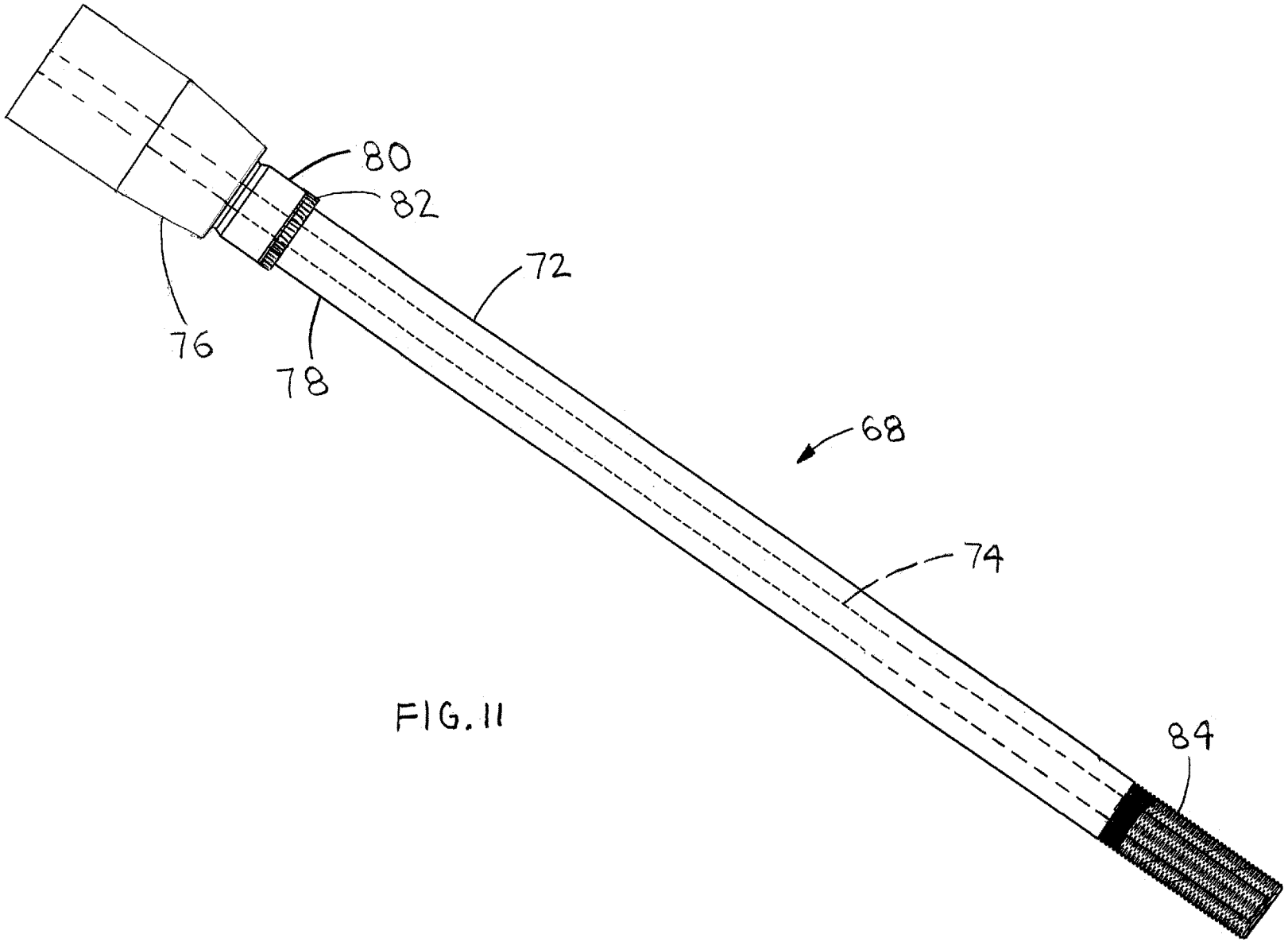
FIG. 11 is a side view of a second elongated tube of a second embodiment of a firearm barrel with non-metal outer sleeve in accordance with the present invention.

With reference to FIGS. 10-11, a second embodiment of a firearm barrel with non-metal outer sleeve 2 preferably includes a second firearm barrel 68, a non-metal tube 70 and the sleeve nut 16. The second firearm barrel 68 includes a second elongated tube 72. A second barrel inner diameter 74 is formed through a length of the second elongated tube 72. Suitable twist rifling is applied to the second barrel inner diameter 74. Material is preferably removed from the second elongated tube 72 to form an end taper 76, a reduced outer diameter 78 and a raised sleeve support section 80. The end taper 76 is formed near an entrance end of the second elongated tube 72. The raised sleeve support section 80 is formed adjacent the end taper 76. The raised sleeve support section 80 preferably includes a straight knurled portion 82 disposed in front of the raised sleeve support section 80. The straight knurled portion 82 will prevent rotation of the non-metal tube 70 relative to the second elongated tube 72 in rare circumstances. A sleeve thread 84 is formed on an exit end of the second elongated tube 72. The firearm barrel is preferably fabricated from any suitable steel, but other materials may also be used. The sleeve nut 16 includes the threaded bore 58, which is sized to threadably receive the sleeve thread 84.

The non-metal tube 70 includes a tube inner diameter and a plurality of openings 88 formed through a wall of the non-metal tube 70. The plurality of openings may 88 have any suitable spacing, size and shape. The tube inner diameter is sized to slidably receive an outer diameter of the raised sleeve support section 80, the straight knurled portion 82 and the tube end 54 of the sleeve nut 16. The non-metal tube 70 is preferably fabricated from carbon fiber, but other non-metal materials could also be used.

The firearm barrel with non-metal outer sleeve 2 is preferably assembled in the following manner. The non-metal tube 70 is slid over the exit end of the second elongated tube 72 on to the raised sleeve support section 80. The sleeve nut 16 is threaded onto the sleeve thread 84 to retain the non-metal tube 70 on the second elongated tube 72. The outer diameter of the tube end 54 is not threadably engaged with the inner diameter of the non-metal tube 70 as shown in FIG. 5. Tightening the sleeve nut 16 has the unexpected result of tensioning the rifling in the inner diameter of the elongated tube 72 and improving shooting accuracy of the firearm barrel with non-metal outer sleeve 2. The non-metal tube 70 allows the weight of the firearm barrel with non-metal outer sleeve 2 to be reduced while improving shooting accuracy. The sleeve nut 16 is threaded on to the sleeve thread 38, tightening of the sleeve nut 16 is not limited by a discontinuation of the sleeve thread 38 on the elongated tube 20 when the rotation flange 56 is in contact with the non-metal tube 70. Additionally, an outer diameter of the tube end 54 is in contact with the inner barrel diameter of the non-metal tube 70, the outer diameter of the tube end 54 is not threadably engaged with the inner diameter of the non-metal tube 70. Shooting accuracy is also improved by having the tube end 54 of the sleeve nut 16 concentric with the threaded bore 58 by no greater than .001 inches and the second barrel inner diameter 74 concentric with the second elongated tube 72 by no greater than .001 inches. The above concentricity also applies to the firearm barrel with non-metal outer sleeve 1.

Figure 11A:
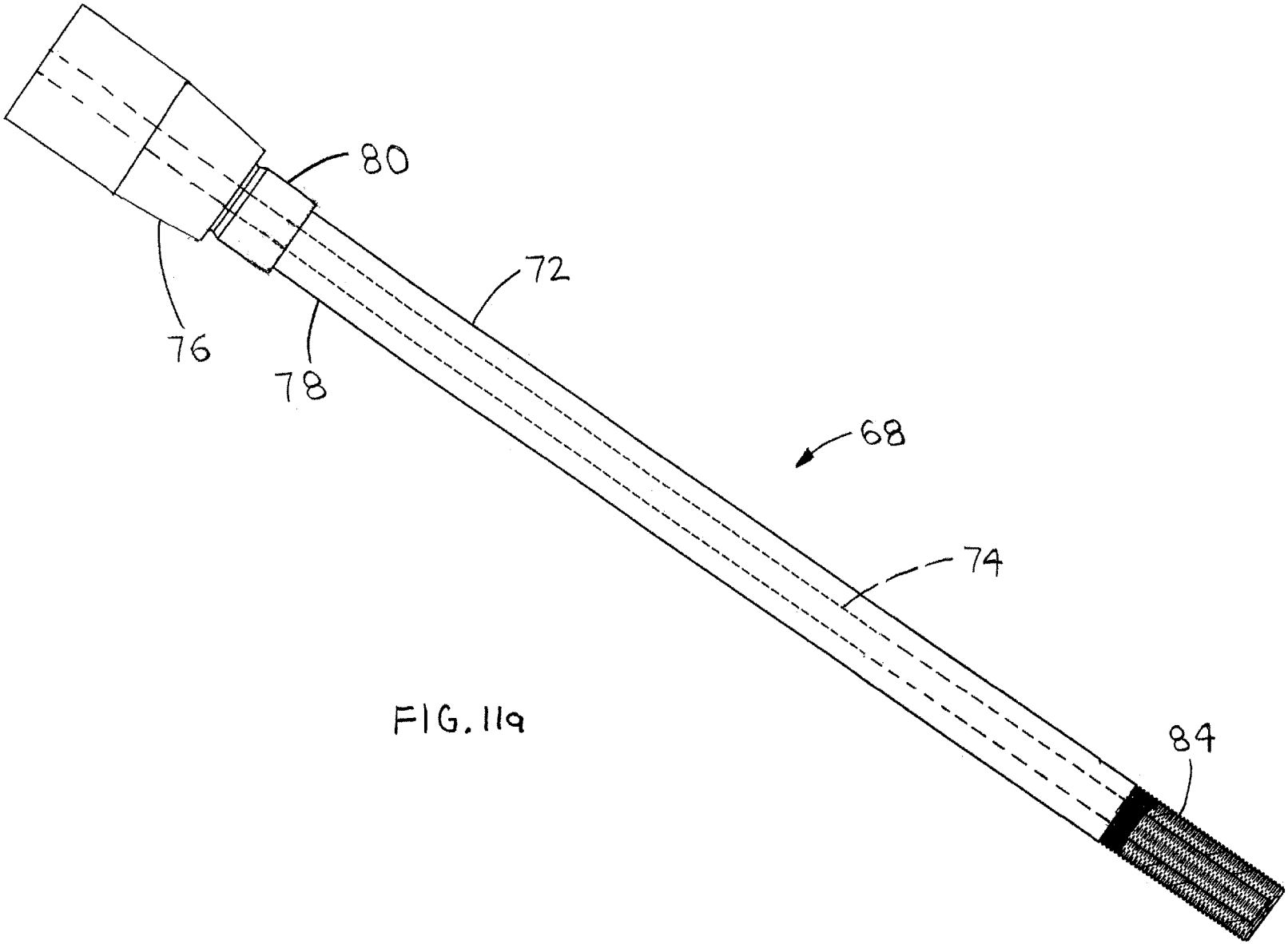
FIG. 11*a* is a side view of a second elongated tube without a straight knurled portion of a second embodiment of a firearm barrel with non-metal outer sleeve in accordance with the present invention.

With reference to FIG. 11*a*, an alternative design of the raised sleeve support section 80 includes a diameter, which is about .004 inches less than an inner diameter of the non-metal tube 70. The lesser diameter of the raised sleeve support section 80 can vary from between .002-.006 inches, but other dimension could also be used instead of about .004 inches. A bonding substance is applied to the raised sleeve support section 80. The raised sleeve support section 80 is inserted into non-metal tube 70 and rotated to ensure that any suitable bonding substance is evenly distributed around a gap between the inner diameter of the non-metal tube 70 and the raised sleeve support section 80. Concentricity between the non-metal tube 70 and the barrel tube 72 is set, before the bonding substance cures. The following product is given by way of example and not way of limitation. An example of a suitable bonding substance is J-B Weld®. The above bonding also applies to the firearm barrel with non-metal outer sleeve 1.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A firearm barrel with a non-metal tube comprising:

a barrel tube including an outer barrel surface, an inner barrel surface, an entrance end and an exit end, a sleeve thread formed on said exit end, and a raised sleeve support formed on an end opposite said exit end;

said non-metal tube including an inner surface, said inner surface having an inner perimeter which is greater than an outer perimeter of said raised sleeve support;

a bonding substance applied to at least one of said raised sleeve support and said inner surface to fill a gap between said raised sleeve support and said inner surface; and a sleeve nut including a tube end, a sleeve inner thread formed through said sleeve nut, said tube end in contact with said inner surface of said non-metal tube, wherein said barrel tube is inserted through said non-metal tube, wherein said sleeve nut is threaded on to said sleeve thread to retain said non-metal tube, wherein tightening said sleeve nut increases tension on a length of said barrel tube, and wherein concentricity of said non-metal tube is set relative to said barrel tube with said sleeve nut, before said bonding substance cures, said bonding substance locating said raised sleeve support with respect to said inner surface of said non-metal tube to lock spacing between said barrel tube and said non-metal tube.

2. The firearm barrel with said non-metal tube of claim 1 wherein:

an air gap is created between said inner surface of said non-metal tube and said outer barrel surface of said barrel tube.

3. The firearm barrel with said non-metal tube of claim 1 wherein:

said sleeve nut includes a rotation flange, said tube end extends from said rotation flange, and said tube end is sized to receive said inner surface of said non-metal tube.

4. The firearm barrel with said non-metal tube of claim 1 wherein:

said sleeve inner thread is concentric with said tube end.

5. A firearm barrel assembly comprising:

a non-metal tube having an inner surface;

a barrel tube having an outer barrel surface, an inner barrel surface, an entrance end and an exit end, a sleeve thread formed on said exit end, and a raised sleeve support on an end opposite said exit end;

a bonding substance applied to at least one of said raised sleeve support and said inner surface to fill a gap between said raised sleeve support and said inner surface, wherein said raised sleeve support is received within said non-metal tube; and a sleeve nut including a tube end and a sleeve inner thread formed through said sleeve nut, said sleeve nut threaded on to said sleeve thread and retaining said non-metal tube on said barrel tube, wherein said tube end is concentric with said barrel tube;

wherein tightening of said sleeve nut on said sleeve thread compresses said non-metal tube and increases tension on a length of said barrel tube, and wherein concentricity between said non-metal tube and said barrel tube is set with said sleeve nut before said bonding substance cures, said bonding substance locating said raised sleeve support with respect to said inner surface of said non-metal tube to lock spacing between said barrel tube and said non-metal tube.

6. The firearm barrel assembly of claim 5 wherein:

an air gap is defined between said inner surface of said non-metal tube and said outer surface of said barrel tube.

7. The firearm barrel assembly of claim 5 wherein:

said non-metal tube is fabricated from carbon fiber.

8. The firearm barrel assembly of claim 5 wherein:

said sleeve nut includes said tube end and a rotation flange, wherein said tube end extends from said rotation flange and receives said inner surface of said non-metal tube.

9. A firearm barrel assembly comprising:

a barrel tube having an outer barrel surface, an inner barrel surface, an entrance end and an exit end, a sleeve thread formed on said exit end, and a raised sleeve support on an end opposite said exit end;

a non-metal tube having an inner surface, said inner surface has an inner perimeter which is greater than an outer perimeter of said raised sleeve support;

a bonding substance applied to at least one of said raised sleeve support and said inner surface to fill a gap between said raised sleeve support and said inner surface; and a sleeve nut including a tube end and a sleeve inner thread formed through said sleeve nut, said sleeve nut threaded on to said sleeve thread and retaining said non-metal tube on said barrel tube;

wherein concentricity of said non-metal tube is set relative to said barrel tube by tightening said sleeve nut before said bonding substance cures, said bonding substance locating said raised sleeve support with respect to said inner surface of said non-metal tube to lock spacing between said barrel tube and said non-metal tube.

10. The firearm barrel assembly of claim 9 wherein:

said outer surface of said barrel tube has a diameter which is less than a diameter of said raised sleeve support.

11. The firearm barrel assembly of claim 9 wherein:

an air gap is defined between said inner surface of said non-metal tube and said outer surface of said barrel tube.

12. The firearm barrel assembly of claim wherein:

said non-metal tube is fabricated from carbon fiber.

13. The firearm barrel assembly of claim 9 wherein:

said sleeve nut includes said tube end and a rotation flange, wherein said tube end extends from said rotation flange and receives said inner surface of said non-metal tube.

* * * * *